US010459374B2

(12) United States Patent
Funatsu

(10) Patent No.: US 10,459,374 B2
(45) Date of Patent: Oct. 29, 2019

(54) IMAGE FORMING APPARATUS

(71) Applicant: Oki Data Corporation, Tokyo (JP)

(72) Inventor: Kenichi Funatsu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/228,154

(22) Filed: Dec. 20, 2018

(65) Prior Publication Data

US 2019/0196366 A1 Jun. 27, 2019

(30) Foreign Application Priority Data

Dec. 27, 2017 (JP) ..... 2017-251272

(51) Int. Cl.
*G03G 15/16* (2006.01)

(52) U.S. Cl.
CPC ..... *G03G 15/161* (2013.01); *G03G 15/1615* (2013.01)

(58) Field of Classification Search
CPC .. G03G 15/161; G03G 15/14; G03G 15/0131; G03G 15/0189; G03G 15/168; G03G 15/1615; G03G 15/5008
See application file for complete search history.

(56) References Cited

U.S. PATENT DOCUMENTS 8,095,043 B2 * 1/2012 Matsuura ..... G03G 15/752 399/161
2007/0242965 A1 * 10/2007 Akamatsu ..... G03G 15/0131 399/49
2016/0291516 A1 * 10/2016 Taniguchi ..... G03G 15/0136

FOREIGN PATENT DOCUMENTS

JP 2006-171233 A 6/2006

* cited by examiner

*Primary Examiner* — Hoang X Ngo
(74) *Attorney, Agent, or Firm* — Muncy, Geissler, Olds & Lowe, P.C.

(57) ABSTRACT

An image forming apparatus includes an image forming part, a transfer member, a carrying part, a control part, a contact/separation part that performs a separation operation through which the transfer member and the developer carrier become relatively separated, and a contact operation through which the transfer member and the developer carrier become in contact each other at a contact timing. Before the control part finishes transferring a developer image to a recording medium at a secondary transfer position, the contract/separation timing control part sets a separation timing, and the contact/separation performs the separation operation.

8 Claims, 12 Drawing Sheets

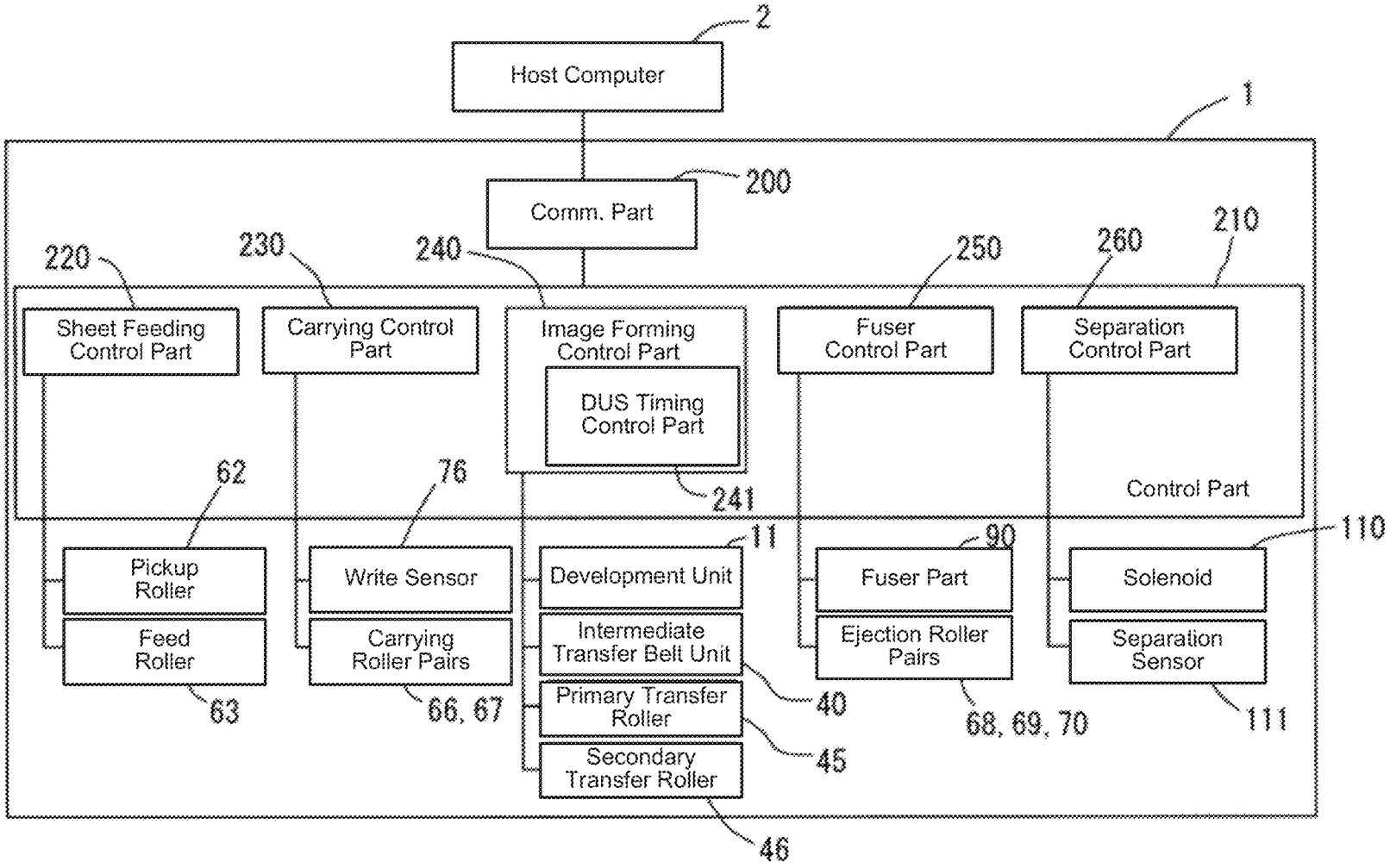
Fig. 4
1
2
Host Computer
200
Comm. Part
210
Control Part
Separation Control Part
260
Fuser Control Part
250
Image Forming Control Part
DUS Timing Control Part
241
240
Carrying Control Part
230
Sheet Feeding Control Part
220
110
Solenoid
Separation Sensor
111
90
Fuser Part
Ejection Roller Pairs
68, 69, 70
11
Development Unit
Intermediate Transfer Belt Unit
40
Primary Transfer Roller
45
Secondary Transfer Roller
46
Write Sensor
76
Carrying Roller Pairs
66, 67
Pickup Roller
62
Feed Roller
63

IMAGE FORMING APPARATUS

TECHNICAL FIELD

This invention relates to the control of an image forming apparatus, especially the control of an image forming apparatus of an intermediate transfer system.

BACKGROUND

In a tandem type color image forming apparatus of an intermediate transfer system, mostly, color printing is performed by driving development units of all colors in contact with an intermediate transfer belt, and monochrome printing is performed by stopping color (yellow (Y), magenta (M), and cyan (C)) development units separated from the intermediate transfer belt and letting only a black (K) development unit contact with the intermediate transfer belt, so as not to consume the life of the color (Y, M, and C) development units during the monochrome printing.

Also, proposed is an apparatus (e.g., see Patent Document 1) that allows individual color development units independently to separate from or contact with the intermediate transfer belt, for example, because two color printing of red and black does not use (Y) or (C), printing is performed by stopping the (Y) and (C) development units separated from the intermediate transfer belt and letting only the used (K) and (M) units contact with the intermediate transfer belt, so as not to consume the life of unused color development units.

RELATED ART/PATENT DOCUMENT(S)

[Patent Document 1] Japanese Unexamined Patent Application No. 2006-171233 (Page 6, FIG. 1)

In an intermediate transfer type printing apparatus, there is a problem that if a development unit is separated from an intermediate transfer belt while executing a secondary transfer that transfers an image to a medium, a shock when the development unit leaves the intermediate transfer belt is transmitted to the intermediate transfer belt, generating a shock line in the image on the medium. Therefore, there is a problem that even after the image formation for the last page in the development unit is complete, the development unit must continue to be driven until the transfer of the image of the final page onto the medium is finished in the secondary transfer, having an idling period from the completion of the image formation to the completion of the secondary transfer, and consuming the life of the development unit. There are apparatuses having a long distance between the primary transfer and the secondary transfer for the convenience in configuring the apparatus, and in such an apparatus the above-mentioned idling period becomes long, and life consumption due to idling of the development unit also becomes large.

SUMMARY

An image forming apparatus, disclosed in the application, includes an image forming part that forms a developer image on a developer carrier that is rotatable, a transfer member that is rotatable and in contact with the developer carrier at a primary transfer position and to which the developer image is transferred from the image forming part, a carrying part that is in contact with the transfer member at a secondary transfer position and carries a recording medium to which the developer image, which was transferred to the transfer member, is further transferred, a control part that controls the image forming part, the transfer member and the carrying part, and controls an image forming operation through which the developer image is transferred onto a prescribed portion of the recording medium at the secondary transfer position, a contact/separation part that performs two operations at the secondary transfer position at operation timings wherein these operations are: a separation operation through which the transfer member and the developer carrier become relatively separated, the separation operation being performed at a separation timing, which is one of the operation timings, and a contact operation through which the transfer member and the developer carrier, which are separated, become in contact each other at a contact timing, which is the other of the operation timings, and a contact/separation timing control part that controls the operation timings performed by the contact/separation part, wherein before the control part finishes transferring the developer image to the recording medium at the secondary transfer position, the contract/separation timing control part sets the separation timing, and the contact/separation performs the separation operation.

According to the image forming apparatus of this invention, because developer carriers can be separated from a transfer member before the secondary transfer is complete, life consumption of development units due to idling can be suppressed.

BRIEF DESCRIPTION OF THE DRAWINGS

FIG. 2A is its side view, and FIG. 2B is its front view.

FIG. 3A is its side view, and FIG. 3B is its front view.

FIG. 4 is a block diagram showing the configuration of the control system of the image forming apparatus in Embodiment 1.

DETAILED DESCRIPTION OF PREFERRED EMBODIMENT

Embodiment 1

Figure 1:
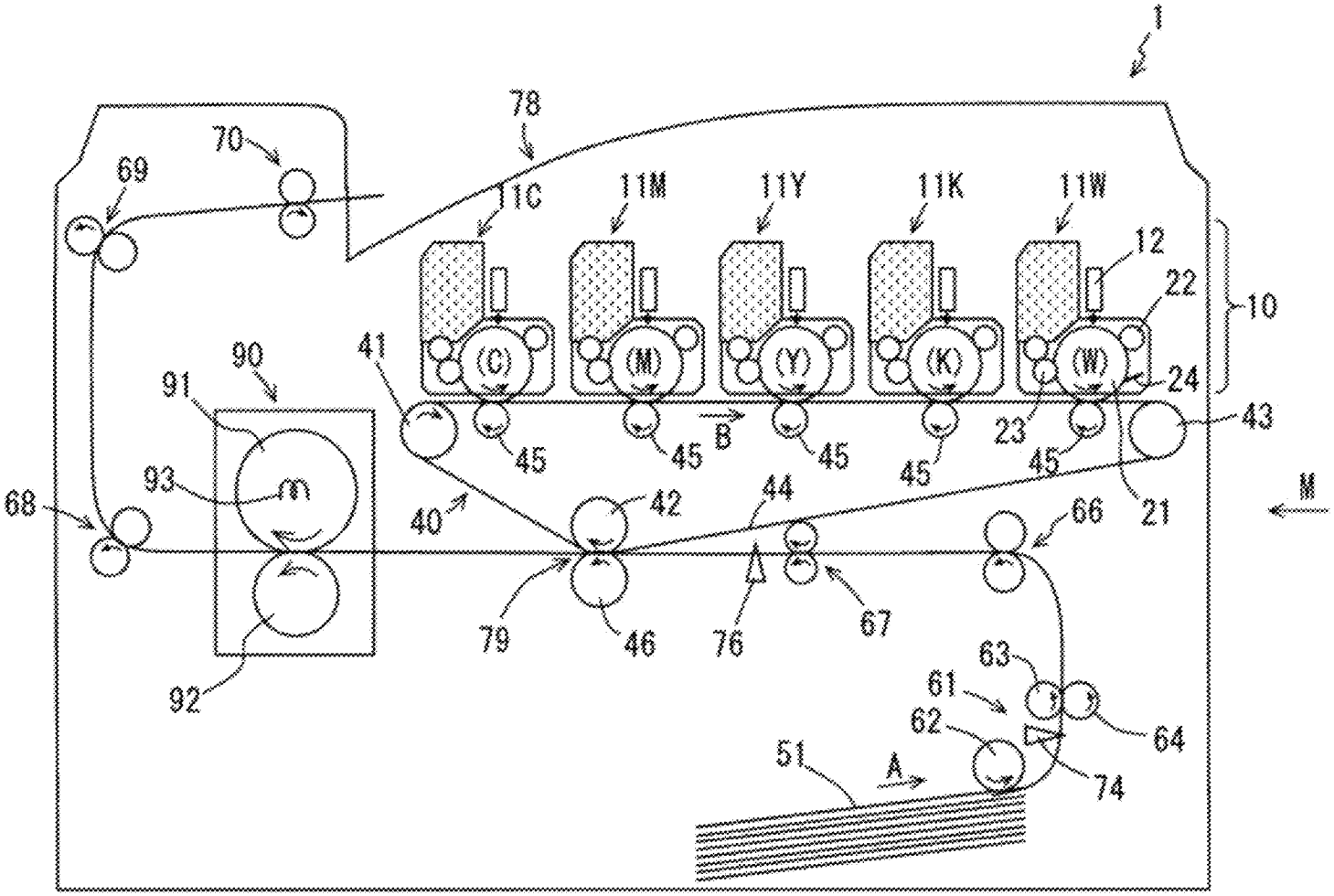
FIG. 1 is a main part configuration diagram showing the main part of an image forming apparatus of Embodiment 1 by this invention.

FIG. 1 is a main part configuration diagram showing the main part configuration of an image forming apparatus 1 of Embodiment 1 by this invention.

In the same figure, explanations are given regarding the image forming apparatus 1 as an electrophotographic printer that forms images by an electrophotographic system. Recording sheets 51 as a print medium are accommodated in a stacked state inside an unshown sheet feeding cassette, and a pickup roller 62 together with a carrying sensor 74, and a feed roller 63 and a retard roller 64 arranged as a pair in contact with each other, forms a sheet forwarding part 61.

The pickup roller 62 and the feed roller 63 are rotationally driven in the direction of an arrow by an unshown motor and can idle in the arrow direction even when the rotational drive stops because an unshown one-way clutch mechanism is built inside. Also, by an unshown torque generation means, the retard roller 64 generates a torque in the direction of an arrow that is different from the direction of rotation driven by the feed roller 63. Therefore, the pickup roller 62 extracts the recording sheet 51 in contact with it from inside the sheet feeding cassette, and even when multiple pieces of the recording sheets 51 are simultaneously extracted, the feed roller 63 and the retard roller 64 sequentially forward one piece of these recording sheets 51 at a time to a carrying route.

Sequentially arranged in the downstream side of the sheet feeding part 61 in the direction of an arrow A indicating the carrying direction of the recording sheet 51 are a carrying roller pair 66 that corrects skew of the recording sheet 51, a carrying roller pair 67 that sends the recording sheet 51 to a secondary transfer part 79, and a write sensor 76 for taking a write timing in a color image forming part 10. To these carrying roller pairs 66 and 67, a drive force is transmitted from an unshown carrying drive motor via an also unshown drive transmission means such as gears.

The color forming part 10 has five development units 11C, 11M, 11Y, 11K, and 11W (simply labeled as 11 if there is no particular need to distinguish them) that respectively form individual color toner images of cyan (C), magenta (M), yellow (Y), black (K), and white (W), and these are disposed sequentially from the upstream side along the direction of an arrow B indicating the moving direction of an intermediate transfer belt 44 of a below-mentioned intermediate transfer belt unit 40 in the upper part of the intermediate transfer belt unit 40

Because the internal configurations of these development units 11 as the image forming part are common, the internal configuration is explained using the white (W) development unit 11W as an example.

Figure 7:
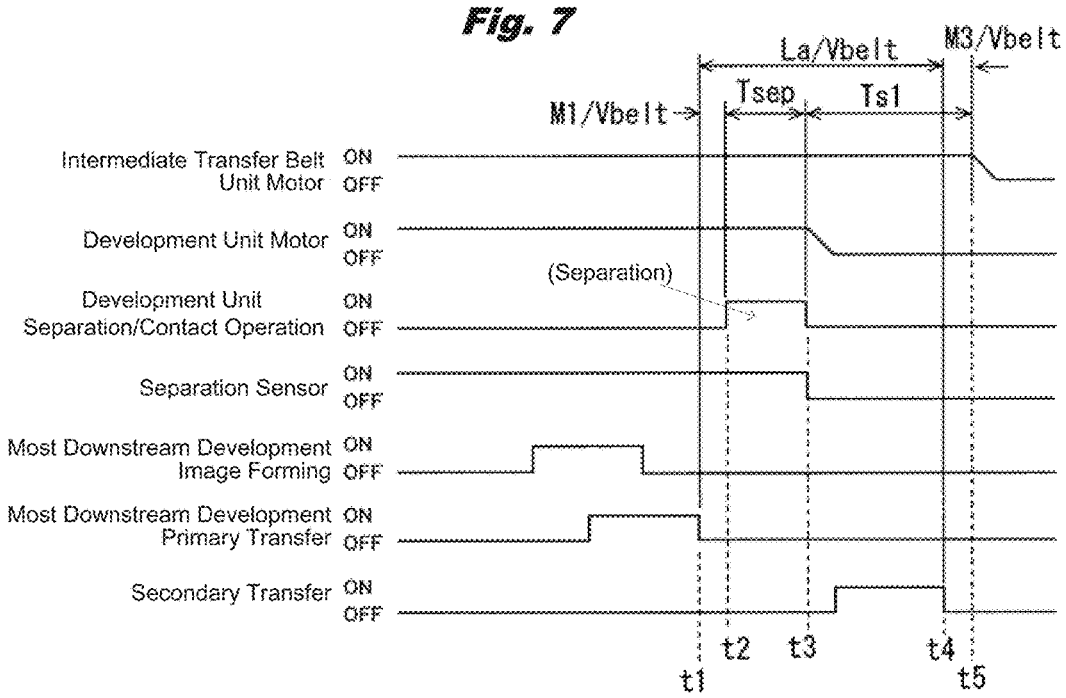
FIG. 7 is a timing chart showing the operation timings of individual parts of the image forming apparatus in Embodiment 1.

In the development unit 11W, a photosensitive drum 21 as a developer carrier is disposed rotatably in the direction of an arrow and is rotationally driven in the same direction by an unshown development unit motor (see FIG. 7). Sequentially arranged around this photosensitive drum 21 from the upstream side of its rotation direction are a charging roller 22 that charges the surface of the photosensitive drum 21 by supplying a charge, and an exposure device 12 that forms an electrostatic latent image by selectively radiating light onto the charged surface of the photosensitive drum 21. Further arranged are a development roller 23 that lets white (W) toner adhere onto the surface of the photosensitive drum 21 to develop the electrostatic latent image formed there, and a cleaning blade 24 that removes transfer residual toner remaining after transferring the toner image on the photosensitive drum 21.

The intermediate transfer belt unit 40 is provided with a drive roller 41 driven by an unshown intermediate transfer belt unit motor (see FIG. 7), a tension roller 43 that adds tension to the intermediate transfer belt 44 by a bias means such as a coil spring, a secondary transfer backup roller 42 disposed opposing a secondary transfer roller 46 to constitute a secondary transfer part 79, and the intermediate transfer belt 44 as a transfer member stretched over those rollers, and is further provided with five primary transfer rollers 45 disposed opposing the photosensitive drums 21 of the individual development units 11 to apply specific voltages for transferring the individual color toner images formed on the individual photosensitive drums 21 sequentially superimposed onto the intermediate transfer belt 44.

This intermediate transfer belt unit 40 transfers the toner images formed by the color image forming part 10 mentioned above to the intermediate transfer belt 44, and further transfers these toner images to the recording sheet 51 supplied from the sheet feeding cassette in the secondary transfer part 79 together with the secondary transfer roller 46.

A fuser part 90 comprises a roller pair of an upper roller 91 that is provided with a halogen lamp 93 as a heat source inside and has its surface formed with an elastic body and a lower roller 92 having its surface formed with an elastic body, melts the toner image by applying heat and a pressure to the toner image on the recording sheet 51 forwarded from the secondary transfer part 79, and fuses this image with the recording sheet 51.

Afterwards, the recording sheet 51 is carried by ejection roller pairs 68, 69, and 70, and ejected to a stacker part 78 in due course. To these ejection roller pairs, a drive force is transmitted via an unshown drive transmission means from an unshown drive source.

The five development units 11 are configured displaceable individually between positions that are separated from or in contact with the intermediate transfer belt 44 by a contact/separation mechanism mentioned below. For example, the development units 11 that are in contact with the intermediate transfer belt 44 and driven during an image formation are the development units 11 corresponding to four colors of (C), (Y), (M), and (K) in color printing, only the development unit 11K corresponding to black (K) in monochrome printing, only the development unit 11W corresponding to white (W) in white (W) only printing, and the development units 11 corresponding to five colors of (C), (Y), (M), (K), and (W) in five-color printing. Each of the development units contains a toner of which color is different from others. Black is one of the colors in the invention.

Figure 2B:
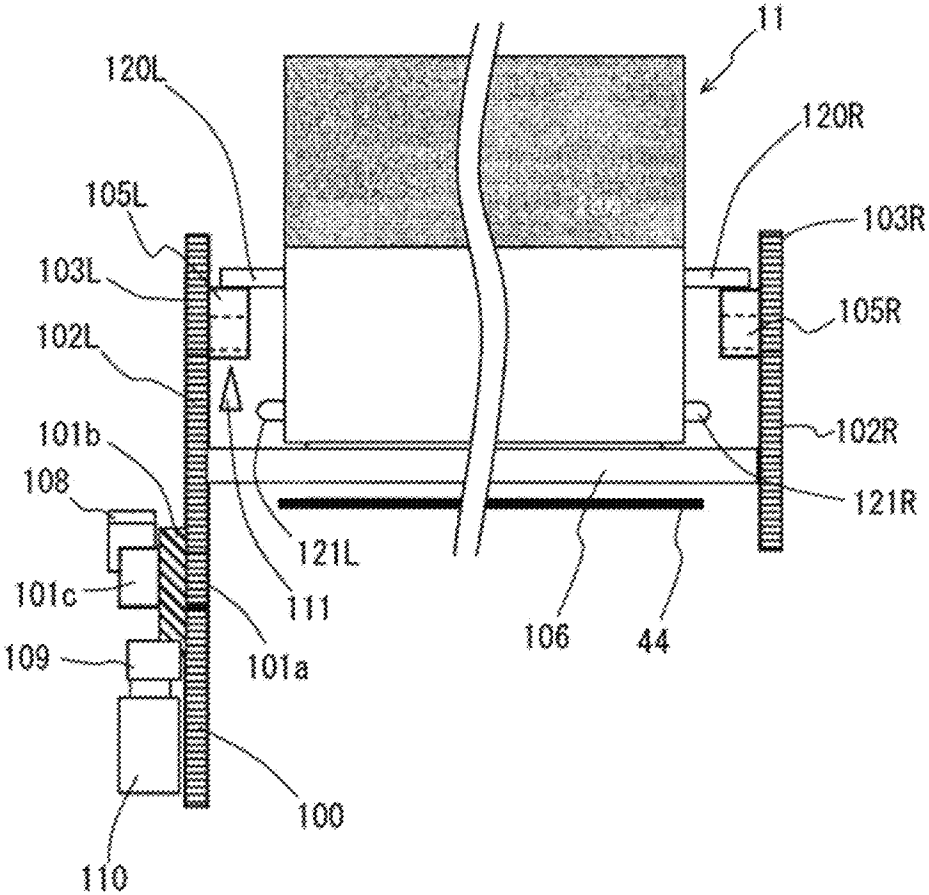
FIGS. 2A and 2B are main part configuration diagrams showing the main part of the contact/separation mechanism in a state where the development unit is separated from the intermediate transfer belt.
Figure 2A:
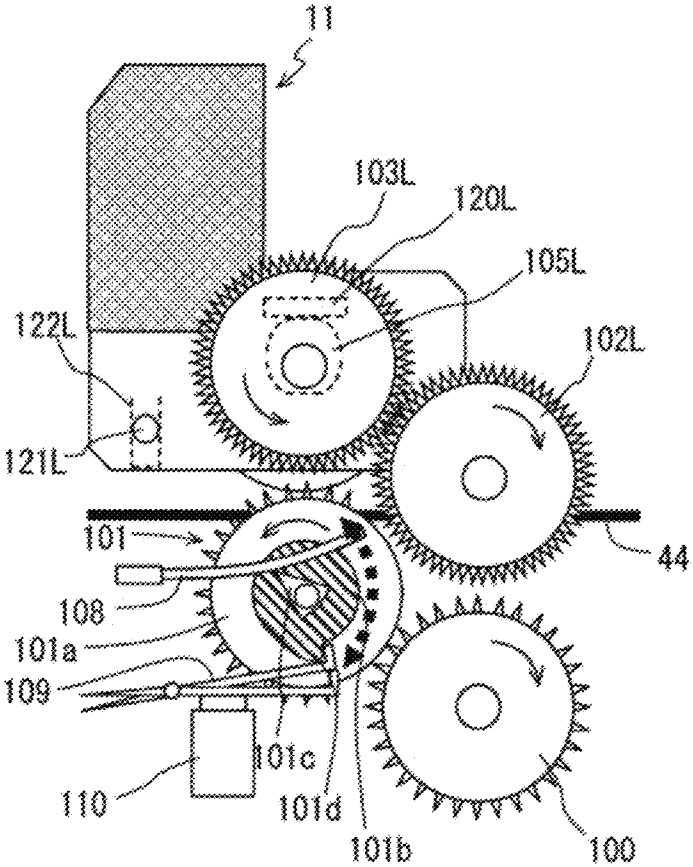
Figure 3B:
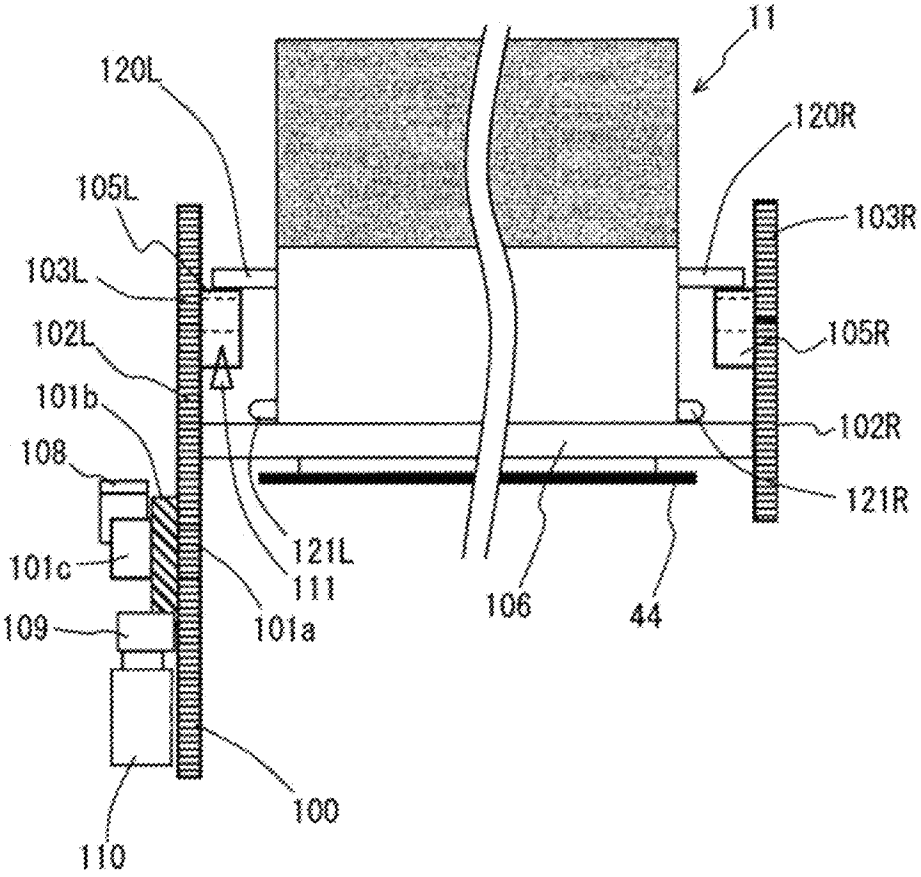
FIGS. 3A and 3B are main part configuration diagrams showing the main part configuration of the contact/separation mechanism in a state where the development unit is in contact with the intermediate transfer belt.
Figure 3A:
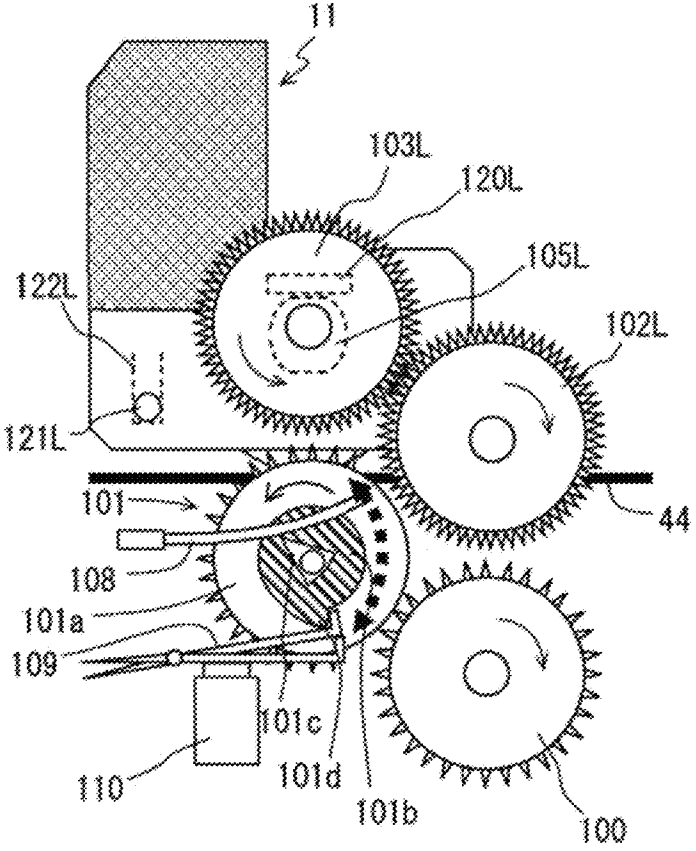

FIG. 2 is a main part configuration diagram showing the main part configuration of the contact/separation mechanism that depicts a state where the development unit 11 is separated from the intermediate transfer belt 44, where (a) is its side view, and (b) is its front view. In the same manner, FIG. 3 is a main part configuration diagram showing the main part configuration of the contact/separation mechanism that depicts a state where the development unit 11 is in contact with the intermediate transfer belt 44, where (a) is its side view, and (b) is its front view.

This image forming apparatus 1 is capable of letting the development units 11 individually separate from or contact with the intermediate transfer belt 44 by a contact/separation mechanism. A gear 100 is connected with the drive source (development unit motor, see FIG. 7) of the development unit 11 through an unshown gear array, and once the development unit 11 is driven by the unshown drive source, the gear 100 is also driven.

A gear 101 is the core of the contact/separation mechanism and is formed of a gear part 101*a*, a latch 101*b* having a protruding part 101*d*, and a claw 101*c* that receives a reaction force of a spring 108 integrated coaxially. Also, a range of the gear part 101*a* indicated with a broken arrow is missing gear teeth.

The gear 101 is prevented from rotating in one direction (the direction of an arrow) by a gear stop 109 driven by a solenoid 110 being hooked onto the protruding part 101*d* of the latch 101*b*. Also, in this state the gear 101 cannot rotate in the reverse direction either because its rotational force is biased in the same direction by the reaction force of the spring 108 applied to the claw 101*c* as mentioned below.

Also, because the gear 101 is configured so that the gear teeth missing part comes to the engagement position of the gear 100 and a gear 102 in this state, in a stopped state where the gear stop 109 is hooked on the protruding part 101*d* of the latch 101*b*, the connection between the gear 100 and the gear 102 is kept off.

The gear 102L is a relay gear for transmitting the drive force of the gear 101 to a gear 103L, is connected coaxially through a shaft 106 with a gear 102R disposed on the opposite side across the development unit 11, and is configured so that once the gear 102L is driven by the gear 101, the gear 102R is also driven through the shaft 106, and a gear 103R meshing with the gear 102R is also driven.

Note that as shown in FIG. 1, there are cases where the right and left, the upper and lower, and the front and back of the image forming apparatus 1 are specified viewed from the direction of an arrow M, and in the contact/separation mechanism shown in FIGS. 2 and 3, the gear 102L disposed on the left side of the development unit 11 and the gear 102R disposed on the right side of the development unit 11 are formed in plane symmetry with respect to a virtual reference plane intersecting perpendicularly with the shaft 106 in its central part. In the same manner, members formed in left-right plane symmetry with respect to this virtual reference plane are distinguished by adding "L" or "R" at the end of their codes, and because the configurations and operations of these members are left-right symmetrical, explanations are occasionally given for only one of them.

The gear 103L (103R) is a gear formed coaxially and integrally with a cam 105L (105R) for contacting with the development unit 11 and letting the development unit 11 separate from or contact with the intermediate transfer belt 44, and is driven by the gear 102L (102R). Installed on the development unit 11 is a support plate 120L (120R) in contact with the circumferential face of the cam 105L (105R), and by the support plate 120L (120R) moving up or down by the rotation of the cam 105L (105R), the development unit 11 separates from or contacts with the intermediate transfer belt 44.

Also, installed on the development unit 11 is a post 121L (121R) so as to engage with a slit 122L (122R) installed vertically on the frame of the image forming apparatus 1. This is for the development unit 11 to move vertically up or down during the separation/contact operation of the development unit 11. The contact/separation state of the development unit 11 relative to the intermediate transfer belt 44 can be detected by a separation sensor 111, and when the development unit 11 is in a separated state, the separation sensor 111 turns off.

Next, referring to FIG. 2 showing a state where the development unit 11 is separated from the intermediate transfer belt 44 and FIG. 3 showing a state where the development unit 11 is in contact with the intermediate transfer belt 44, explained is a series of separation operations of the contact/separation mechanism in transitioning from a contact state shown in FIG. 3 to the separated state shown in FIG. 2.

First, in the state shown in FIG. 3, once the development unit 11 is driven by the unshown development unit motor (see FIG. 7), the gear 100 rotates in the direction of an arrow (clockwise). Subsequently, once the solenoid 110 is turned on, the tip side of the gear stop 109 is attracted toward the solenoid 110 side, and its tip part comes off the protruding part 101*d* of the gear 101. Thereby, the gear 101 biased by the reaction force of the spring 108 rotates in the direction of an arrow (anticlockwise) to let the gear 100 mesh with the gear teeth part of the gear 101, and the gear 101 is driven in the same direction by the gear 100. Once the gear 101 makes about a half round, the solenoid 110 is turned off, thereby the gear stop 109 returns to the original rotational position.

Once the gear 101 is driven by the gear 100, the gear teeth part of the gear 101 reaches the gear 102L, thereby the gear 102L (102R) is driven in the direction of an arrow (clockwise). Once the gear 102L (102R) is driven, the gear 103L (103R) is also driven in the direction of an arrow (anticlockwise), and the cam 105L (105R) also rotates in the same direction. Thereby, the support plate 120L (120R) of the development unit 11 is pushed up by the cam 105L (105R), separating the development unit 11 from the intermediate transfer belt 44. Note that the numbers of gear teeth of the gear 101 and the gear 102L have a 1:2 relationship, configured so that the gear 102L makes a half round while the gear 101 makes one round.

Because the gear 101 has the gear teeth missing part, once the gear teeth missing part comes to a position opposing the gear 100, its meshed state is released, therefore its driving stops, and the gear 102L also becomes unable to receive a drive force. However, because the cam 105L (105R) has such a shape that opposing circumferential faces are cut so as to become a pair of parallel faces and corners of the cut shoulder parts are shaved, it is configured so that once the gear 103L (103R) receives a drive force to reach a position beyond the shoulder part of the cam 105L (105R), it is rotated in the arrow direction (anticlockwise) by the self-weight of the development unit 11 and stops in a position where the parallel faces of the cam become horizontal. FIG. 2 shows a state at such time.

Because the gear 101 is designed so that when the gear teeth missing part comes to a position opposing the gear 100, the claw 101*c* comes to a position receiving the reaction force of the spring 108, it is biased and continues to rotate in the same direction by the reaction force of the spring 108. However, because the solenoid 110 is already off at this time, in due course the protruding part 101*d* of the latch 101*b* contacts with and stops at the gear stop 109 that returned to the original rotational position into a state restricted to this stop position.

By the series of operations mentioned above, the development unit 11 transitions from the contact state to the separated state relative to the intermediate transfer belt 44, and by repeating this series of operations once again, it transitions from the separated state to the contact state this time. Therefore, it becomes possible to let the development unit 11 separate from or contact with the intermediate transfer belt 44 by repeating this series of operations.

Note that the gears 100-103, the cam 105, the shaft 106, the spring 108, the gear stop 109, the solenoid 110, the separation sensor 111, the support plate 120, the post 121, the slit 122, etc. correspond to a contact/separation means.

FIG. 4 is a block diagram showing the configuration of the control system of the image forming apparatus 1.

As shown in the same figure, the image forming apparatus 1 is configured of a communication part 200 and a control part 210 as a control means, and the control part 210 has a sheet feeding control part 220 that controls driving the pickup roller 62 and the feed roller 63 to control feeding the recording sheet 51, a carrying control part 230 that receives information from the write sensor 76 and controls driving the carrying roller pairs 66 and 67 to control carrying the recording sheet 51, an image formation control part 240 that controls driving the development units 11, the intermediate transfer belt unit 40, the primary transfer roller 45, and the secondary transfer roller 46 to control processes until transferring toner images formed in the development units 11 to the recording sheet 51, a fuser control part 250 that controls driving the fuser part 90 and the ejection roller pairs 68-70 to fuse the toner images on the recording sheet 51 with the recording sheet 51 by heat, and a separation control part 260 that receives information from the separation sensor 111 and controls driving the solenoid 110 to control the contact/separation of the development units 11 relative to the intermediate transfer belt 44.

Also, the image formation control part 240 is further provided with a development unit separation timing control part 241, referred as DUS Timing Control Part in the drawing, and instructs the timings of the separation operations by a separation control part 260 as mentioned below.

In the image forming apparatus 1 of the above-mentioned configuration, once print data are transmitted from a higher-level device such as a host computer 2, the communication part 200 receives them and issues a print execution instruction to the control part 210. Upon receiving the print execution instruction, the control part 210 determines colors used for printing, lets the development units 11 to be used contact with the intermediate transfer belt unit 40, and lets the unused development 11 separate from the intermediate transfer belt unit 40.

Next, an image formation is started by the image formation control part 240, the recording sheet 51 is fed by the sheet feeding control part 220, the fed recording sheet 51 is carried by the carrying control part 230, the timing with a toner image created on the intermediate transfer belt 44 is adjusted by the image formation control part 240, and the toner image is transferred onto the recording sheet 51 by the secondary transfer roller 46. The toner image transferred onto the recording sheet 51 is thermally fused on the recording sheet 51 by the fuser control part 250 and is ejected to the outside of the apparatus.

Figure 5:
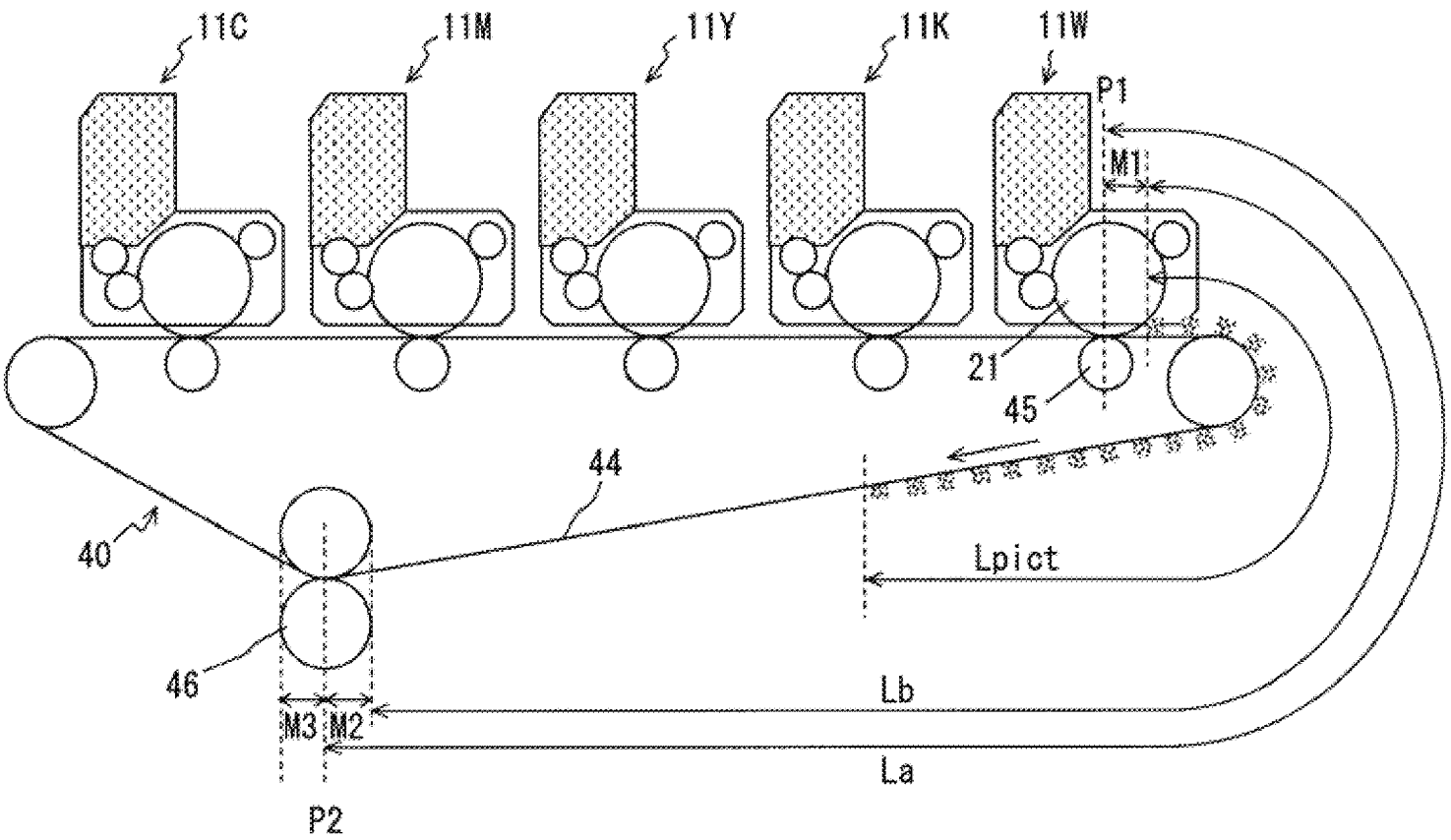
FIG. 5 is a dimensional drawing for explaining the dimensions of individual parts of the image forming apparatus related to the separation timing in Embodiment 1.

Next, explained is the timing that the image forming apparatus 1 by this invention separates the development units 11 from the intermediate transfer belt unit 40 when printing of the print data is finished. FIG. 5 is a dimensional drawing for explaining the dimensions of individual parts of the image forming apparatus 1 related to this separation timing.

In the same figure, M1 is a margin distance from a primary transfer position P1 of the development unit 11W located in the most downstream side for not affecting the trailing edge part of a toner image on the intermediate transfer belt 44 even if the separation operations start after the primary transfers of toner images onto the intermediate transfer belt 44 from the development units 11 are finished.

M2 is a margin distance from a secondary transfer position P2 for the separation operations of the development units 11 not to affect the leading edge part of a toner image on the intermediate transfer belt 44 during the secondary transfer by the secondary transfer roller 46, and the separations of the development units 11 need to be finished before the leading edge of the image comes to this position. M3 is a margin distance from the secondary transfer position P2 travelled since the secondary-transferred recording sheet 51 passed the secondary transfer roller 46 until the development units 11 and the intermediate transfer belt 44 stop.

The above margin distances may be determined as follows:

M1 is 3 to 5% of a circumference of the photosensitive drum.

M2 is about 0.1 inches or is any distance as long as not to reach the roller.

M3 is 5 to 10% of a circumference of the second transfer roller.

La (L1) is a moving distance of the image on the intermediate transfer belt 44 from the primary transfer position of the most downstream development unit 11W to the secondary transfer position by the secondary transfer roller 46, Lb indicates a range where the primary-transferred toner image of the most downstream development unit 11W exists on the intermediate transfer belt 44, and if the separation operations of the development units 11 are complete while the image on the intermediate transfer belt 44 is within this range Lb, the toner image on the intermediate transfer belt 44 is not affected. Therefore, the length of Lb becomes (La−M1−M2). Lpict (L3) is the image length of the toner image on the intermediate transfer belt 44. The image length is defined in a carrying direction of intermediate transfer belt 44.

Note that although the moving distance La and the range Lb are measured with the most downstream development unit 11W as their starting point, because they are distances using the most downstream among the driven development units 11 as the reference point, the starting point changes according to the driven development units 11. Also, M1, M2, La, Lb, and Lpict indicate distances in a simplified mode in FIG. 5, each indicates a distance along the moving route of the intermediate transfer belt 44, and should desirably be obtained with an accuracy of about 0.1 mm. In the invention, the most downstream development unit is determined at every time when one image forming operation for a single page is performed. For example, when image forming units (11C, 11M, 11Y) are selected for completing one image forming operation, the most downstream development unit is unit 11Y. When image forming units (11C, 11Y, 11K) are selected for another image forming operation, the most downstream development unit is unit 11K.

Figure 6:
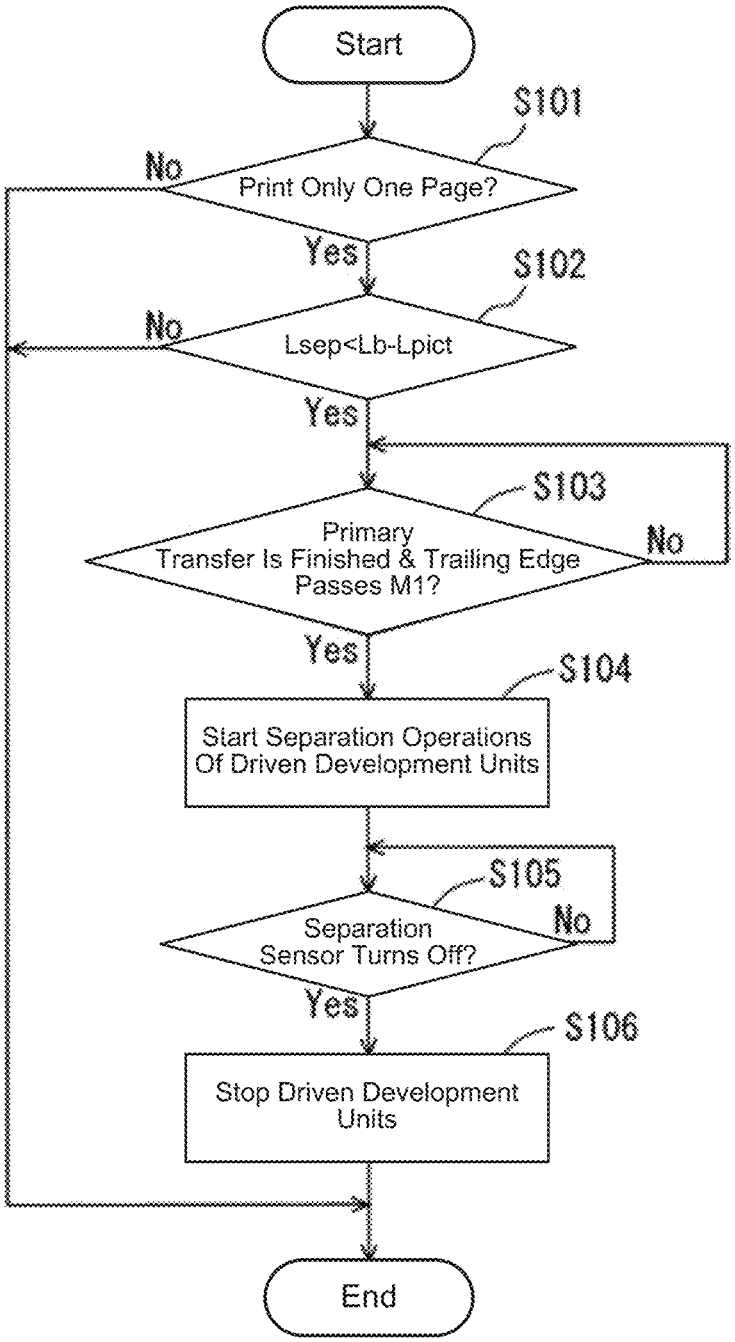
FIG. 6 is a flow chart showing the flow of the early separation process executed by the development unit separation timing control part in Embodiment 1.
Figure 8:
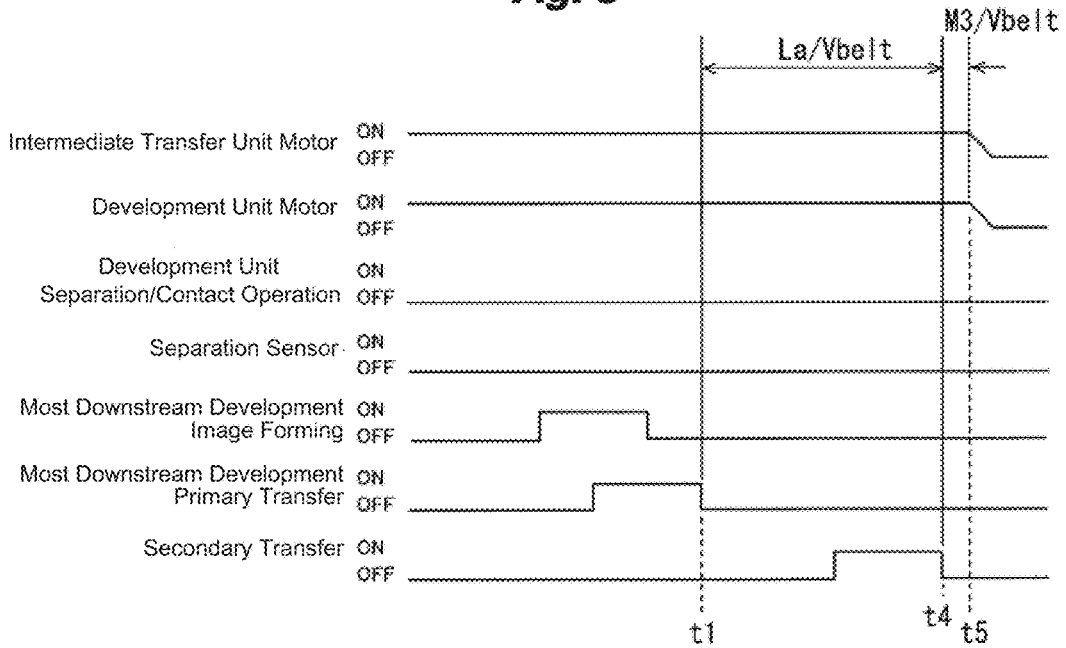
FIG. 8 is a timing chart showing the operation timings of individual parts as a reference example.

FIG. 6 is a flow chart showing the flow of an early separation process executed by the development unit separation timing control part 241 in this embodiment, FIG. 7 is a timing chart showing the operation timings of individual parts, and FIG. 8 is a timing chart showing the operation timings of the individual parts as a reference example.

In printing only one page, the image forming apparatus 1 here allows stopping the development units 11 separated from the intermediate transfer belt 44 before finishing the secondary transfer without generating any shock line in a toner image on the recording sheet 51 when finishing the printing. The flow of processes by the development unit separation timing control part 241 for executing the above-mentioned early separation process is explained according to a flow chart in FIG. 6 referring mainly to the dimensional drawing in FIG. 5.

Once printing starts, the development unit separation timing control part 241 that is part of the image formation control part 240 determines whether it is printing only one page (S101), if it is printing only one page (S101, Yes), determines whether it is eligible to separate the development units 11 before the toner image primary-transferred to the intermediate transfer belt 44 reaches the secondary transfer position P2 (S102). The determination here is performed in the following manner.

First, time Tsep required for the separation operations of the development units 11 is calculated by the following Equation (1).

$$Tsep = Tsol + TG101Free + Tsnsoff \quad (1)$$

where Tsol: Solenoid reaction time, TG101Free: Time until the gear 101 is driven by the reaction force of the spring 108 to mesh with the gear 100 and further with the gear 102, and Tsnsoff: Time since driving the gear 102 started until the separation sensor 111 turns off (that varies according to the drive speed of the development unit 11).

Next, by the following Equation (2), a distance Lsep (L2) is calculated by converting the time Tsep to an equivalent distance based on the drive speed Vbelt of the intermediate transfer belt 44.

$$Lsep = Tsep \times Vbelt \text{ (mm/sec)} \quad (2)$$

where (Drive speed Vbelt of the intermediate transfer belt 44)≈(Circumferential speed of the photosensitive drum 21 of the development unit 11). Then, depending on whether the following Inequality (3) holds true, determines whether it is eligible to separate the development units 11 without affecting the image on the intermediate transfer belt 44.

$$Lsep < Lb - Lpict \quad (3)$$

If Inequality (3) holds true in S102 and if it is determined that the development units 11 can be separated before the toner image on the intermediate transfer belt 44 reaches the secondary transfer position P2 (S102, Yes), after waiting until the primary transfer of the toner image in the most downstream driven development unit 11W is finished and the trailing edge of the toner image passes the margin distance M1 from the primary transfer position P1 (S103), the separation operations of the driven development units 11 start (S104). Herein, when only one development unit is being driven, one separation operation for the one development unit is to be performed. Afterwards, after waiting until the separation sensor 111 turns off (S105), driving of the driven development units 11 stops (S106).

The above-mentioned early separation process allows separating the driven development units 11 from the intermediate transfer belt 44 before finishing the secondary transfer of the toner image on the intermediate transfer belt 44 to the recording sheet 51 and further stopping their driving.

FIG. 7 is a timing chart showing the operation timings of individual parts during the early separation process mentioned above in this embodiment.

In the same figure, the intermediate transfer belt unit motor is included in the image formation control part 240 for example, and when it is on, it rotationally drives the drive roller 41 of the intermediate transfer belt unit 40 to transport the intermediate transfer belt 44 at the drive speed Vbelt in the arrow B direction (FIG. 1). The development unit motors are provided in the image formation control part 240 for example, corresponding to the individual development units 11, and when they are on, drive the photosensitive drum 21 of the respective development units 11 at a prescribed circumferential speed (≈the drive speed Vbelt).

As shown in the same figure, if the primary transfer by the most downstream development unit 11W is finished at time t1 when the intermediate transfer belt unit motor and the development unit motors are on and the intermediate transfer belt 44 is being driven at the drive speed Vbelt, the separation operations of the driven development units 11 start at time t2 when the trailing edge of the toner image transferred to the intermediate transfer belt 44 passes the margin distance M1. As mentioned above, these separation operations take the time Tsep (Lsep/Vbelt), and once the separation sensor 111 confirms the separation at the time t3 after the time Tsep passed, the separation operations are simultaneously finished, thereby stopping the development unit motors of the separated development units 11.

Afterwards, in the secondary transfer position P2, the secondary transfer to the recording sheet 51 of the toner image primary-transferred to the intermediate transfer belt 44 starts, and through time t4 when this secondary transfer is finished, at time t5 when the trailing edge of the toner image on the recording sheet 51 passes the margin distance M3 from the secondary transfer position P2, the intermediate transfer belt unit motor is turned off to stop driving the intermediate transfer belt 44. Note that the period from the time t1 when the primary transfers are finished to the time t4 when the secondary transfer is finished corresponds to the period taken for the intermediate transfer belt 44 to move over the moving distance La.

On the other hand, if the above-mentioned early separation process by the development unit separation timing control part 241 is not performed, as shown in FIG. 8, the intermediate transfer belt unit motor and the development unit motors are on, and through time t1 when the primary transfer is finished and time t4 when the secondary transfer is finished by the most downstream development unit 11W, until time t5 when the trailing edge of the toner image on the recording sheet 51 passes the margin distance M3 from the secondary transfer position P2, the development units 11 that already finished the primary transfers are kept in contact with the intermediate transfer belt 44, and their development unit motors are kept on.

Therefore, if the early separation process is performed by the development unit separation timing control part 241, in comparison with the case where no early separation process is performed, time spent for driving the development units 11 is shortened by a shortening period Ts1 that can be obtained by the following equation:

$$\text{Shortening period } Ts1 = \{La - (M1 + Lsep) + M3\}/Vbelt \quad (4)$$

As mentioned above, according to the image forming apparatus 1 of this embodiment, in printing only one page, the development units 11 can be stopped separated from the intermediate transfer belt 44 before the secondary transfer is finished without generating any shock line in the image on the medium, thereby life consumption of the development units 11 can be suppressed.

Embodiment 2

Figure 9:
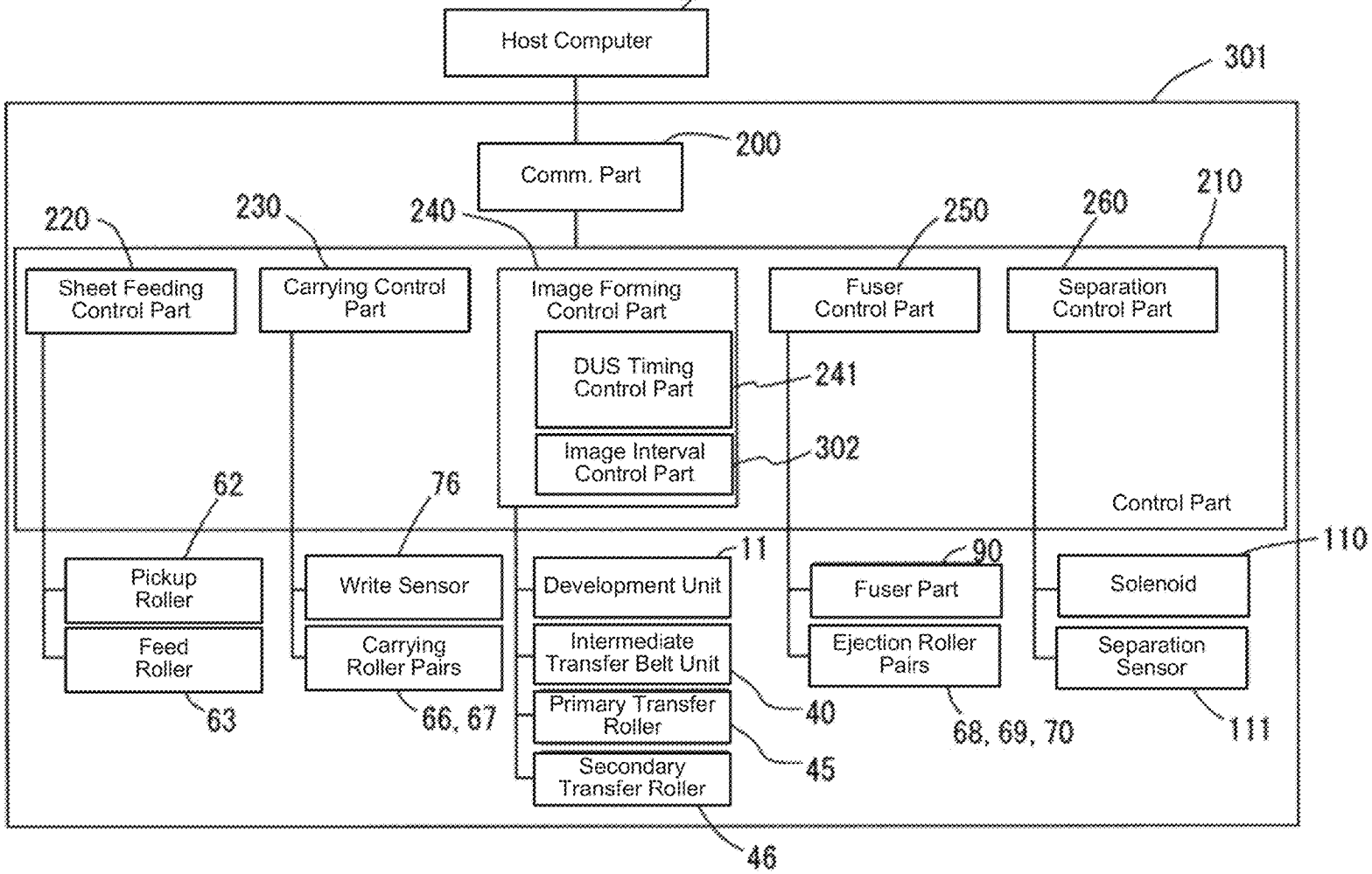
FIG. 9 is a block diagram showing the configuration of the control system of an image forming apparatus of Embodiment 2 based on this invention.

FIG. 9 is a block diagram showing the configuration of the control system of an image forming apparatus 301 of Embodiment 2 based on this invention.

The main difference of the configuration of the control system of this image forming apparatus 301 from the control system of the image forming apparatus 1 of Embodiment 1 shown in FIG. 4 mentioned above is that an image interval control part 302 is added. Therefore, parts of the image forming apparatus with this image interval control part 302 added that are common with the image forming apparatus 1 of Embodiment 1 mentioned above are given the same codes, or their drawings and explanations are omitted, and explanations are focused on their differences. Note that because the configuration of the image forming apparatus 301 of this embodiment is common with the main part configuration of the image forming apparatus 1 of Embodiment 1 shown in FIG. 1 within its range, FIG. 1 is referred to as necessary.

As shown in FIG. 9, an image formation control part 240 is provided with the image interval control part 302 together with the development unit separation timing control part 241.

Figure 10:
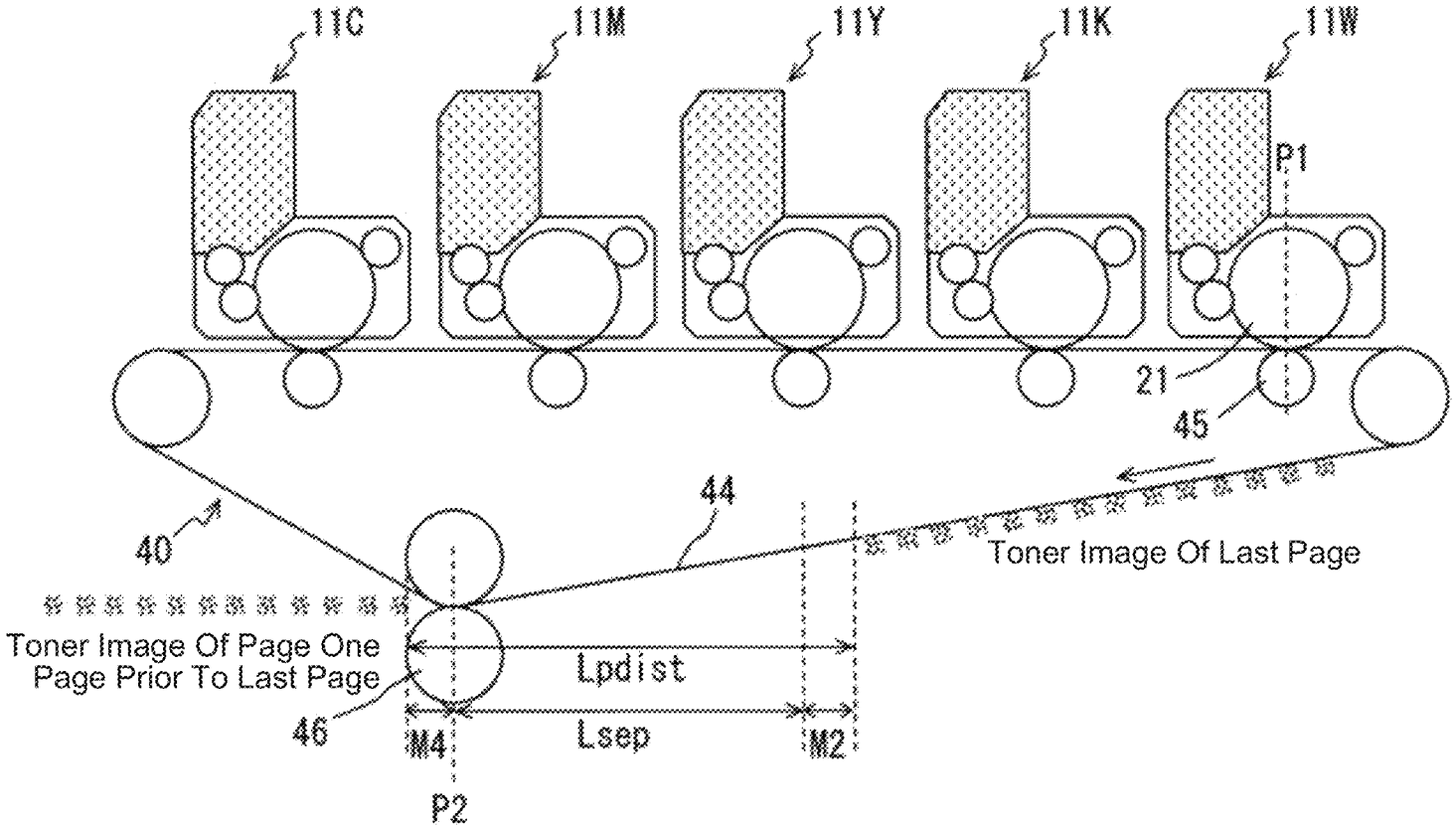
FIG. 10 is a dimensional drawing for explaining the dimensions of individual parts of the image forming apparatus related to the separation timing in Embodiment 2.

Next, explained is the timing when the image forming apparatus 301 by this invention separates development units 11 from an intermediate transfer belt unit 40 in finishing printing of print data. FIG. 10 is a dimensional drawing for explaining the dimensions of individual parts of the image forming apparatus 301 related to this separation timing.

In FIG. 10, M2 is a margin distance for the separation operations of the development units 11 not to affect the leading edge part of a toner image on an intermediate transfer belt 44 in the secondary transfer by a secondary transfer roller 46, and is equivalent to M2 explained in FIG. 5 mentioned above. M4 is a margin distance for the separation operations not to affect the trailing edge of the image transferred to a recording sheet 51 even if the development units 11 started the separation operations. Lsep is the same as Lsep obtained in Embodiment 1 mentioned above. In other words, it is an equivalent distance converted from time Tsep required for the separation operations of the development units 11 based on the drive speed Vbelt of the intermediate transfer belt 44.

Note that although the distances M2, M4, and Lsep are shown in simplified modes in FIG. 10, each of them indicates a distance along the moving path of the intermediate transfer belt 44, and M4 should desirably be obtained with an accuracy of about 0.1 mm.

Figure 11:
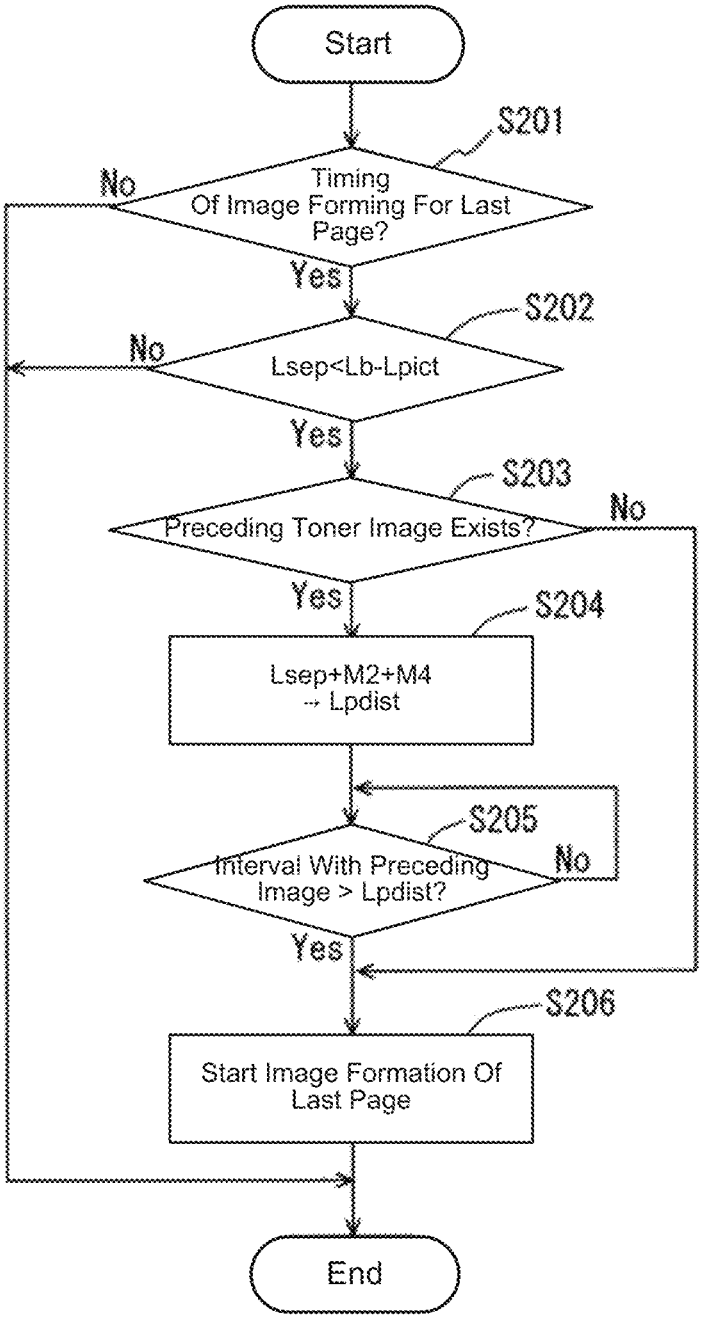
FIG. 11 is a flow chart showing the flow of processes executed by the image interval control part in Embodiment 2.
Figure 12:
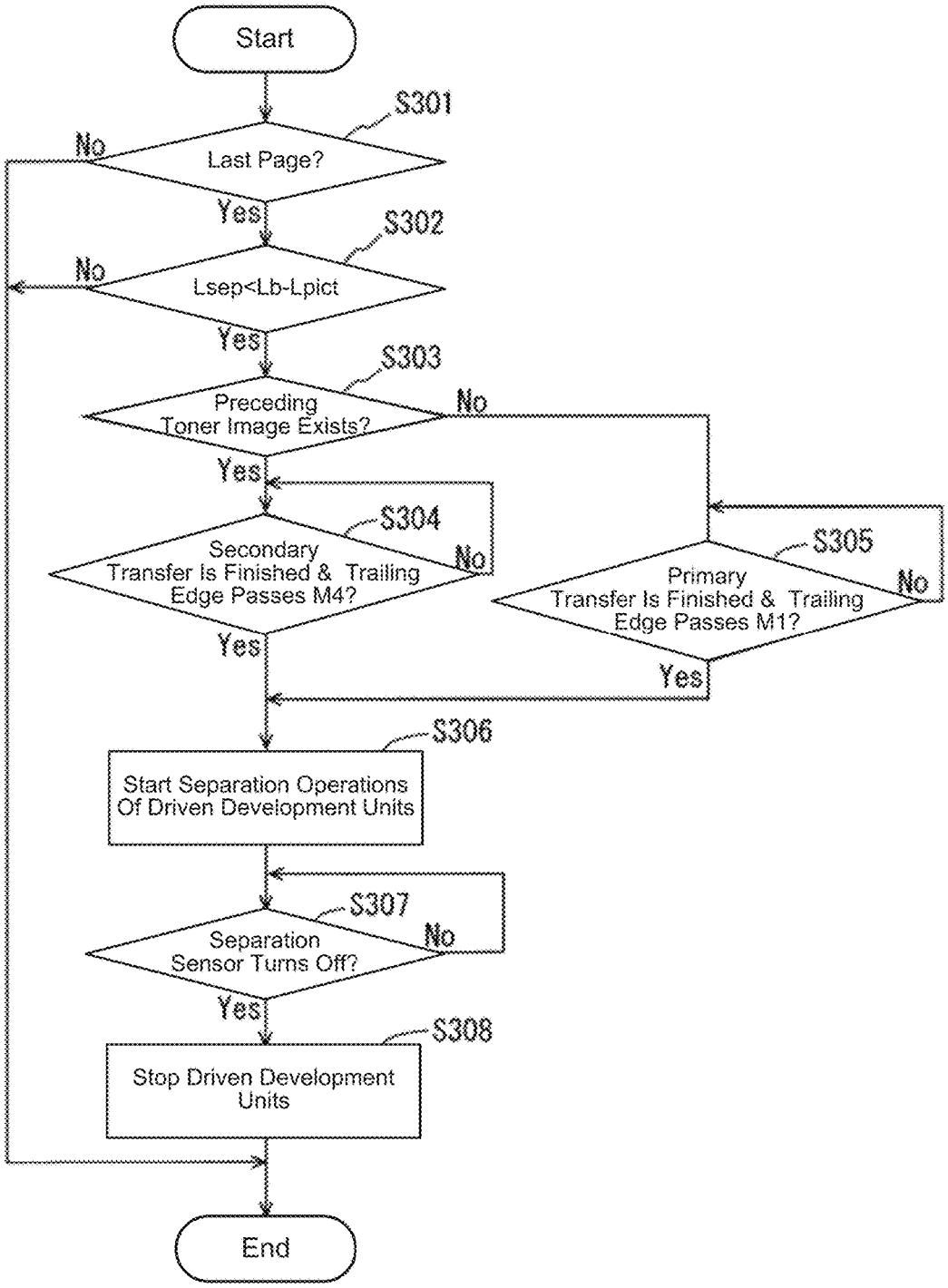
FIG. 12 is a flow chart showing the flow of processes executed by the development unit separation timing control part in Embodiment 2.
Figure 13:
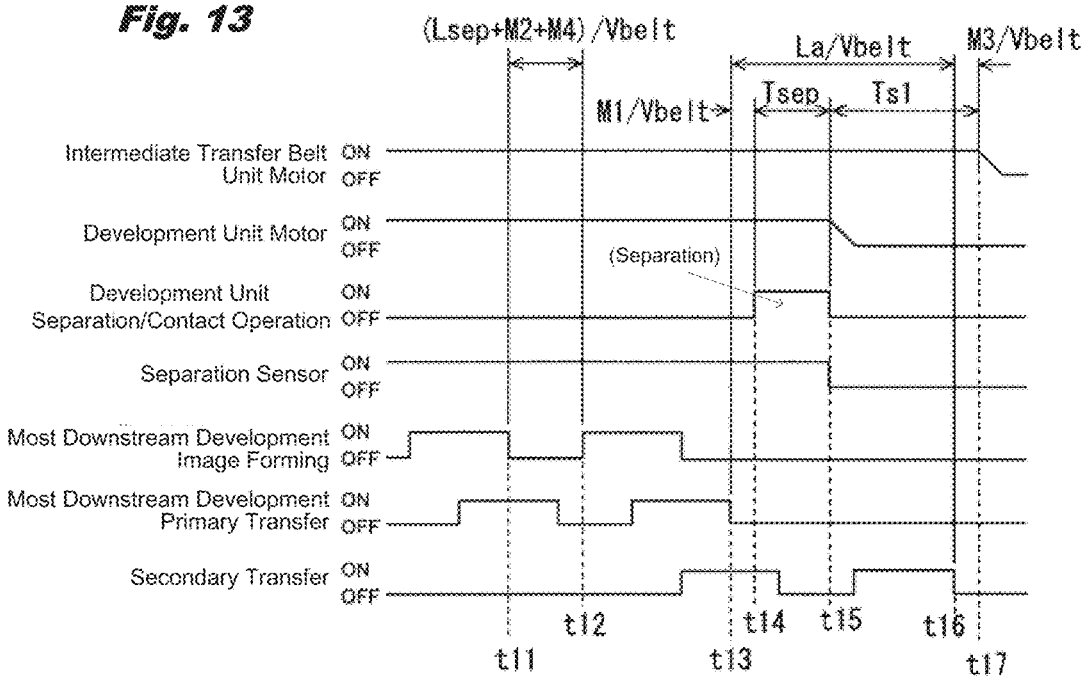
FIG. 13 is a time chart showing the operation timings of individual parts of the image forming apparatus in Embodiment 2.
Figure 14:
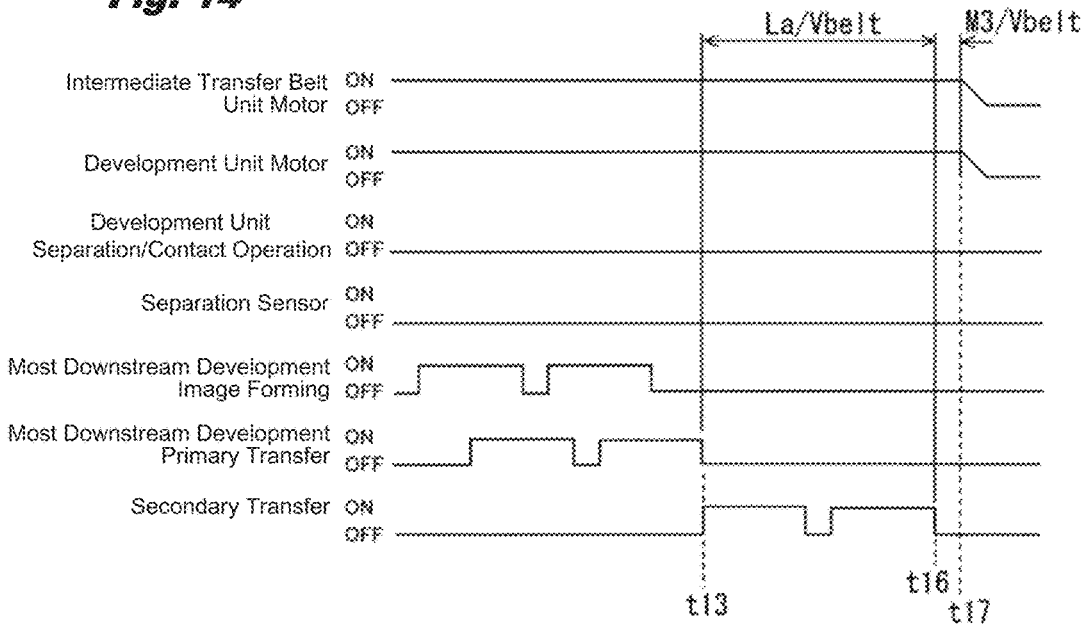
FIG. 14 is a timing chart showing the operation timings of individual parts as a reference example.

FIG. 11 is a flow chart showing the flow of processes executed by the image interval control part 302 in this embodiment, FIG. 12 is a flow chart showing the flow of processes executed by the development unit separation timing control part 241 in this embodiment, FIG. 13 is a timing chart showing the operation timings of individual parts, and FIG. 14 is a timing chart showing the operation timings of individual parts as a reference example.

The image forming apparatus 301 here allows stopping the development units 11 separated from the intermediate transfer belt 44 before the secondary transfer of the last page is finished without generating any shock line in the toner image on the recording sheet 51 in finishing printing when printed pages corresponding to print data become multiple pages. Processes by the image interval control part 302 for allowing an early separation process are explained first according to the flow chart in FIG. 11 referring mainly to the dimensional drawing in FIG. 10.

Once printing starts, before starting an image formation for each page, the image interval control part 302 that is part of the image formation control part 240 determines whether or not it is a timing of the image formation for the last page (S201), if it is the image formation for the last page (S201, Yes), determines whether or not the development units 11 can be separated before starting the secondary transfer of the last page image, in other words, before the toner image of the last page primary-transferred to the intermediate transfer belt 44 reaches the secondary transfer position P2 (S202). Because the determination here is to check whether the above-mentioned Inequality (3) holds true, its detailed explanation is omitted here.

If the separations are eligible (S202, Yes), it is determined whether a preceding toner image exists on the intermediate transfer belt 44 (S203), and if no preceding toner image exists (S203, No), the start of an image formation is immediately instructed (S206).

If a preceding toner image exists on the intermediate transfer belt 44 (S203, Yes), an image interval Lpdist between the preceding toner image and a toner image to be formed next is calculated (S204), and after waiting until the interval with the preceding image becomes Lpdist (S205), the image formation of the toner image of the last page starts (S206).

The image interval Lpdist between the preceding toner image and the image to be formed next can be obtained by the following equation:

$$Lp\text{dist}=L\text{sep}+M2+M4$$

where Lsep is an equivalent distance converted from time Tsep required for the separation operations of the development units 11 and is obtained by the above-mentioned Equations (1) and (2). Therefore, by making the interval with the preceding toner image Lpdist or greater, the execution of the early separation process becomes possible. Above is the explanation of the operations of the image interval control part 302 in this embodiment.

Next, explained are the operations of the development unit separation timing control part 241 for executing the early separation process in this embodiment according to the flow chart in FIG. 12 referring mainly to the dimensional drawing in FIG. 10.

Once printing starts, when starting an image formation for each page, the development unit separation timing control part 241 in this embodiment determines whether it is the last page (S301), and if it is the image formation timing for the last page (S301, Yes), determines whether the development units 11 can be separated before starting the secondary transfer of the last page image (S302). Because the determination here is to check whether the above-mentioned Inequality (3) holds true, its detailed explanation is omitted here.

If the separations are eligible (S302, Yes), it is determined whether a preceding toner image exists on the intermediate transfer belt 44 (S303), and if a preceding toner image exists (S303, Yes), after waiting until the secondary transfer of the preceding toner image is finished and the trailing edge of the toner image transferred to the recording sheet 51 passes the margin distance M4 from the secondary transfer position P2 (S304), the separation operations of the driven development units 11 start (S306). Afterwards, after waiting for the separation sensor 111 to turn off (S307), driving of the development units 11 stops (S308).

At this time, because the toner image of the last page has already been transferred onto the intermediate transfer belt 44 and further formed by securing the interval Lpdist from the toner image of the previous page, that is necessary for executing the separation operations, the toner image of the last page never reaches the secondary transfer position P2 before the separation operations of the development units 11 are finished.

On the other hand, if no preceding toner image exists on the intermediate transfer belt 44 (S303, No), after waiting until the primary transfer of a toner image in the most downstream driven development unit 11W is complete and the trailing edge of the toner image passes the margin distance M1 from the primary transfer position P1 (S305), the separation operations of the driven development units 11 start (S306). Afterwards, after waiting for the separation sensor 111 to turn off (S307), driving of the driven development units 11 stops (S308).

As stated above, even when multiple pages are continuously printed, it becomes possible to separate the driven development units 11 from the intermediate transfer belt 44 and further stop driving them before finishing the secondary transfer of the last page to the recording sheet.

FIG. 13 is a timing chart showing the operation timings of individual parts during the early separation process mentioned above in this embodiment.

As shown in the same figure, when the intermediate transfer belt unit motor and the development unit motors are on, the image formation for the last page starts at time t12 when the intermediate transfer belt 44 has moved by the image interval Lpdist since time t11 when the image formation of the preceding image is finished.

Afterwards, once the primary transfer of the toner image of the last page is finished by the most downstream development unit 11W at time t13, the separation operations of the driven development units 11 start at time t14 when the trailing edge of the toner image transferred to the intermediate transfer belt 44 passes the margin distance M1. As mentioned above, these separation operations take time Tsep (Lsep/Vbelt), once the separation sensor 111 confirms the separations at time t15 after the time Tsep passed, the separation operations are simultaneously finished, thereby the development unit motors of the separated development units stop.

Afterwards, the secondary transfer to the recording sheet 51 of the toner image of the last page transferred to the intermediate transfer belt 44 starts, and through time t16 when this secondary transfer is finished, at time t17 when the trailing edge of the toner image on the recording sheet 51 passes the margin distance M3 from the secondary transfer position P2 (see FIG. 5) the intermediate transfer belt unit motor is turned off to stop driving the intermediate transfer belt 44. Note that the period from the time t13 when the primary transfers are finished until the time t16 when the secondary transfer is finished corresponds to the period when the intermediate transfer belt 44 moves over a moving distance La.

On the other hand, when multiple pages are continuously printed, if the above-mentioned early separation process by the image interval control part 302 and the development unit separation timing control part 241 is not performed, as shown in FIG. 14, the intermediate transfer belt unit motor and the development unit motors are on, and through the time t13 when the primary transfer of the last page image by the most downstream development unit 11W is finished and the time t16 when the secondary transfer of the image is finished, until the time t17 when the trailing edge of the toner image on the recording sheet 51 passes the margin distance M3 from the secondary transfer position P2, the development unit motors of the development units 11 uninvolved with the printing are kept on.

Therefore, if the early separation process is performed by the image interval control part 302 and the development unit separation timing control part 241, in comparison with the case where the early separation process is not performed, time spent for driving the development units 11 is shortened by a shortening period Ts2 that can be obtained by the following equation:

$$\text{Shortening period } Ts2 = Ts1 - \{Lp\text{dist} - (\text{Normal image interval})\}/V\text{belt} \quad (5)$$

As stated above, according to the image forming apparatus 301 of this embodiment, even when multiple pages are continuously printed, it becomes possible to stop the development units 11 separated from the intermediate transfer belt 44 before the secondary transfer of the last page is finished without generating any shock line in an image on a medium.

Note that although in Embodiments 1 and 2 the explanations were given using image forming apparatuses having the development units 11 corresponding to five colors (Y, M, C, K, and W) as examples, this invention is applicable regardless of the number of mounted development units 11. Also, the separation/contact mechanism of the development units 11 shown in FIGS. 2 and 3 is an example, and there is no restriction on its mechanism. For example, the one that directly lets the development units separate from or contact with the intermediate transfer belt using a solenoid etc. or the one that lets the intermediate transfer belt side separate from or contact with the development units can be implemented. Also, although the separation/contact mechanism shown in FIGS. 2 and 3 was explained using an imaging system apparatus that can perform separation/contact of the individual development units independently as an example, this invention can also apply to an apparatus that performs separation/contact of development units for three colors of (Y), (M), and (C) altogether.

Although in this embodiment the image forming apparatus was explained using a printer as an example, in addition to a printer, this invention is also useful for other image forming apparatuses such as a copier, a facsimile, and an MFP (MultiFunction Peripheral) that combines the functions of these apparatuses.

What is claimed is:

1. An image forming apparatus, comprising:

an image forming part that forms a developer image on a developer carrier that is rotatable, a transfer member that is rotatable and in contact with the developer carrier at a primary transfer position and to which the developer image is transferred from the image forming part, a carrying part that is in contact with the transfer member at a secondary transfer position and carries a recording medium to which the developer image, which was transferred to the transfer member, is further transferred, a control part that controls the image forming part, the transfer member and the carrying part, and controls an image forming operation through which the developer image is transferred onto a prescribed portion of the recording medium at the secondary transfer position, a contact/separation part that performs two operations at the secondary transfer position at operation timings wherein these operations are:

a separation operation through which the transfer member and the developer carrier become relatively separated, the separation operation being performed at a separation timing, which is one of the operation timings, and a contact operation through which the transfer member and the developer carrier, which are separated, become in contact each other at a contact timing, which is the other of the operation timings, and a contact/separation timing control part that controls the operation timings performed by the contact/separation part, wherein before the control part finishes transferring the developer image to the recording medium at the secondary transfer position, the contact/separation timing control part sets the separation timing, and the contact/separation performs the separation operation at the separation timing.

2. The image forming apparatus according to claim 1, wherein the contact/separation timing control part determines whether or not the separation operation by the contact/separation part is eligible by considering an image length of the developer image transferred to the transfer member wherein the image length is determined in a direction along which the transfer member runs, and an image moving distance that is determined from the primary transfer position to the secondary transfer position on the transfer member.

3. The image forming apparatus according to claim 2, wherein when developer images corresponding to multiple pages, which includes a last page, of the recording medium are transferred to the transfer member, the control part waits until securing a prescribed image interval that is determined between the developer images, one of the developer images being transferred to the transfer member corresponding to the page preceding the last page and the other of the developer images to be formed on the last page, and starts forming the developer image corresponding to the last page.

4. The image forming apparatus according to claim 2, wherein the developer carrier and the transfer member are rotationally driven by different drive sources.

5. The image forming apparatus according to claim 4, wherein after the contact/separation part performs the separation operation, and before the control part finishes transferring the developer image of the last page to the recording medium at the secondary transfer position, the contact/separation timing part stops the drive source that drives the developer carrier.

6. The image forming apparatus according to claim 1, wherein the contact/separation part is provided with a separation sensor to detect that the developer carrier is separated from the transfer member.

7. The image forming apparatus according to claim 2, wherein the contact/separation timing control part determines that the separation operation is eligible when the following inequality is satisfied:

$$L2<L1-(M1+M2)-L3$$

where

L1 is a distance that the transfer member moves from the primary transfer position to the secondary transfer position, M1 is such a moving distance of the transfer member that is determined from the primary transfer position that the separation operation does not deteriorate a quality of the developer image carried by the transfer member, M2 is such a moving distance of the transfer member to the secondary transfer position that the separation operation does not deteriorate a quality of the developer image carried by the transfer member, L2 is a moving distance of the transfer member that is determined from a timing when the separation operation starts up to a timing when the separation operation finishes, and L3 is the image length.

8. The image forming apparatus according to claim 1, further comprising:

one or more image forming parts that are identical to the image forming part in structure such that each of the image forming parts contains a developer of which color is different from that is contained in the other image forming parts, wherein the transfer member is an intermediate transfer belt, which is an endless belt, that rotates in a moving direction, the image forming parts are disposed in series along the moving direction of the intermediate transfer belt, one of the image forming parts disposed at the most downstream side in the moving direction among those of the image forming parts, which are currently driving, being defined as a most downstream image forming part, and when the control part transfers the developer images formed with the image forming parts to the recording medium through the transfer member, before the developer image that was transferred to the transfer member from the developer carrier of the most downstream image forming part is transferred to the recording medium, a timing is set to separate all the developer carriers from the transfer member by controlling the contact/separation part.

* * * * *